US008033790B2

(12) United States Patent
Vance

(10) Patent No.: US 8,033,790 B2
(45) Date of Patent: Oct. 11, 2011

(54) MULTIPLE PIECE TURBINE ENGINE AIRFOIL WITH A STRUCTURAL SPAR

(75) Inventor: Steven J. Vance, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 581 days.

(21) Appl. No.: 12/239,016

(22) Filed: Sep. 26, 2008

(65) Prior Publication Data

US 2010/0080687 A1 Apr. 1, 2010

(51) Int. Cl.
*F01D 5/30* (2006.01)

(52) U.S. Cl. ..... 416/97 R; 416/213 R; 416/220 R; 416/223 R; 416/232; 416/241 B

(58) Field of Classification Search ..... 416/92, 416/96 A, 96 R, 97 R, 213 R, 200 R, 223 A, 416/226, 232, 241 B
See application file for complete search history.

(56) References Cited

U.S. PATENT DOCUMENTS

| | | | | |
|---|---|---|---|---|
| 3,846,041 | A * | 11/1974 | Albani | 416/97 R |
| 4,137,619 | A | 2/1979 | Beltran et al. | |
| 4,163,629 | A | 8/1979 | McDonough et al. | |
| 4,311,433 | A | 1/1982 | Bratton et al. | |
| 4,370,789 | A | 2/1983 | Schilke et al. | |
| 4,376,004 | A | 3/1983 | Bratton et al. | |
| 4,519,745 | A * | 5/1985 | Rosman et al. | 416/96 A |
| 4,768,700 | A | 9/1988 | Chen | |
| 4,790,721 | A * | 12/1988 | Morris et al. | 416/96 A |
| 5,030,063 | A * | 7/1991 | Berger | 416/220 R |
| 6,193,141 | B1 * | 2/2001 | Burke et al. | 228/190 |
| 6,213,714 | B1 * | 4/2001 | Rhodes | 416/96 R |
| 6,398,501 | B1 * | 6/2002 | Darkins et al. | 416/226 |
| 6,638,639 | B1 | 10/2003 | Burke et al. | |
| 6,976,829 | B2 | 12/2005 | Kovalsky et al. | |
| 7,080,971 | B2 * | 7/2006 | Wilson et al. | 416/92 |
| 7,153,096 | B2 | 12/2006 | Thompson et al. | |
| 7,270,519 | B2 * | 9/2007 | Wadia et al. | 416/236 R |
| 7,316,539 | B2 | 1/2008 | Campbell | |
| 7,452,182 | B2 * | 11/2008 | Vance et al. | 415/135 |
| 7,789,621 | B2 * | 9/2010 | Dierksmeier et al. | 415/191 |
| 7,824,150 | B1 * | 11/2010 | Kimmel et al. | 415/115 |
| 7,828,515 | B1 * | 11/2010 | Kimmel | 415/115 |
| 2008/0025846 | A1 | 1/2008 | Vance et al. | |
| 2008/0260538 | A1 * | 10/2008 | Wilson et al. | 416/97 R |
| 2010/0074759 | A1 * | 3/2010 | Dierksmeier et al. | 416/241 B |

FOREIGN PATENT DOCUMENTS

| | | |
|---|---|---|
| EP | 0 835 742 A2 | 4/1998 |
| EP | 1 085 170 A2 | 3/2001 |
| EP | 1 347 151 A2 | 9/2003 |
| WO | WO 99/33605 | 7/1999 |

* cited by examiner

*Primary Examiner* — Michael Lebentritt

(57) ABSTRACT

A multiple piece turbine airfoil having an outer shell with an airfoil tip that is attached to a root with an internal structural spar is disclosed. The root may be formed from first and second sections that include an internal cavity configured to receive and secure the one or more components forming the generally elongated airfoil. The internal structural spar may be attached to an airfoil tip and place the generally elongated airfoil in compression. The configuration enables each component to be formed from different materials to reduce the cost of the materials and to optimize the choice of material for each component.

20 Claims, 4 Drawing Sheets

MULTIPLE PIECE TURBINE ENGINE AIRFOIL WITH A STRUCTURAL SPAR

STATEMENT REGARDING FEDERALLY SPONSORED RESEARCH

Development of this invention was supported in part by the United States Department of Energy, Contract No. DE-FC26-05NT42646. Accordingly, the United States Government may have certain rights in this invention.

FIELD OF THE INVENTION

This invention is directed generally to airfoils usable in turbine engines, and more particularly to a multiple piece airfoil.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies, to these high temperatures. As a result, turbine airfoils, such as turbine vanes and blades must be made of materials capable of withstanding such high temperatures. In addition, turbine airfoils often contain internal cooling systems for prolonging the life of the airfoils and reducing the likelihood of failure as a result of excessive temperatures.

Typically, turbine airfoils, such as turbine blades are formed from an elongated portion having one end configured to be coupled to an inner rotor assembly. The airfoil is ordinarily composed of a leading edge, a trailing edge, a suction side, and a pressure side. The inner aspects of most turbine airfoils typically contain an intricate maze of cooling circuits forming a cooling system. The cooling circuits in the airfoils receive air from the compressor of the turbine engine and pass the air through the root of the blade that is attached to the rotor assembly. The cooling circuits often include multiple flow paths that are designed to remove heat from the turbine airfoil. At least some of the air passing through these cooling circuits is exhausted through orifices in the leading edge, trailing edge, suction side, and pressure side of the airfoil. While much attention has been paid to cooling technologies, hot spots still occur in the airfoils. In turn, the conventional monolithic airfoils are configured to accommodate the highest heat loads on the airfoil. Typical materials capable of handling the high heat loads of the exhaust gases are often expensive and present manufacturing challenges.

SUMMARY OF THE INVENTION

This invention relates to a multiple piece turbine airfoil formed, from a plurality of components. Forming the turbine airfoil from a plurality of components in a modular fashion enables at least some of the components to be formed from materials that are specifically suited for each component. In particular, the components may be formed from materials capable of being exposed to the localized heat loads without requiring that the entire turbine airfoil be formed from the materials capable of handling the high temperature exhaust gases. Thus, components not exposed to the high temperature exhaust gases may be formed from other materials having lower melting points, which are typically less expensive.

The multiple piece turbine airfoil may include at least one component forming a generally elongated airfoil with an outer wall having a leading edge, a pressure side, and a suction side, wherein the at least one component forming a generally elongated airfoil includes at least one spar receiving chamber. A trailing edge component may be sized to mate with a downstream end of the at least one component forming a generally elongated airfoil. The multiple piece turbine airfoil may include an airfoil tip with a perimeter configuration that matches a perimeter formed by the at least one component forming a generally elongated airfoil and the trailing edge component. The airfoil tip may include at least one spar receiving recess with an outer portion having a larger cross-sectional area than an inner portion for receiving a spar. A root of the multiple piece turbine airfoil may be formed from separate first and second root sections that together form an airfoil receiving cavity for containing an inner end of the at least one component forming a generally elongated airfoil and an inner end of the trailing edge component.

The components of the multiple piece turbine airfoil may be held together by at least one spar extending from the airfoil tip, through the at least one component forming a generally elongated airfoil, and into the airfoil receiving cavity of the first and second root sections. The spar may secure the at least one component forming a generally elongated airfoil, the trailing edge component and the airfoil tip to the root. The spar may include an outer head having a cross-sectional area that fits within the outer portion of the at least one spar receiving recess of the airfoil tip, a body with a cross-sectional area less than the outer head, and a mechanical connection system at a base of the at least one spar. The mechanical connection system at the base of the at least one spar may be a fir-tree configuration that is configured to mate with an internal surface of the first and second root sections.

The first and second root sections may include a mechanical connection system on an outer surface of the first and second root sections. The mechanical connection system may be a fir-tree configuration. The first and second root sections are coupled together with at least one mechanical connector. The spar and the first and second root sections may be formed from materials that are different than materials used to form the at least one component forming the generally elongated airfoil.

In one embodiment, the airfoil component forming a generally elongated airfoil is formed from an outer wall with a single inner spar receiving chamber. In this embodiment, the first and second root sections may include a trailing edge component receiving chamber that is separate from the airfoil receiving cavity. The trailing edge component may also include internal cooling channels, such as, but not limited to, a pin fin cooling array.

In another embodiment, the component forming the generally elongated airfoil may be formed from two sections, a leading edge section and a middle section. Two spars may extend from the airfoil tip, through the two sections forming a generally elongated airfoil, and into the airfoil receiving cavity of the first and second root sections. An intersection between the leading edge section and the middle section may include a seal formed from an offset sidewall. In addition, an intersection between the middle section and the trailing edge component may include a seal formed from an offset sidewall.

An advantage of this invention is that the turbine airfoil support system of the instant invention is formed from a plurality of components in a modular manner that enables the components to be formed from different materials such that less expensive, low melting point materials may be used with internal components not subjected to the hot gas flow path.

Another advantage of this invention is that the turbine airfoil support system of the instant invention is formed from a plurality of components in a modular manner that enables parts to be more easily manufactured than conventional monolithic airfoils.

Yet another advantage of this invention is that the turbine airfoil support system of the instant invention enables the outer wall of the airfoil component to be loaded with a compressive force at the perimeter of the airfoil that enhances the ability of the airfoil to absorb tensile forces during turbine engine operation without airfoil failure. Specifically, application of the compressive forces at the perimeter of the airfoil concentrates compressive forces at the perimeter of the airfoil and reduces the likelihood of failure at the fillets at the transition between the airfoil and the platforms.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

As shown in FIGS. 1-7, this invention is directed to a multiple piece turbine airfoil 10 formed from a plurality of components 12. Forming the turbine airfoil 10 from a plurality of components 12 in a modular fashion enables at least some of the components to be formed from materials that are specifically suited for each component. In particular, the components 12 may be formed from materials capable of being exposed to the localized heat loads without requiring that the entire turbine airfoil 10 be formed from the materials capable of handling the high temperature exhaust gases. Thus, components 12 not exposed to the high temperature exhaust gases may be formed from other materials having lower melting points, which are typically less expensive.

Figure 1:
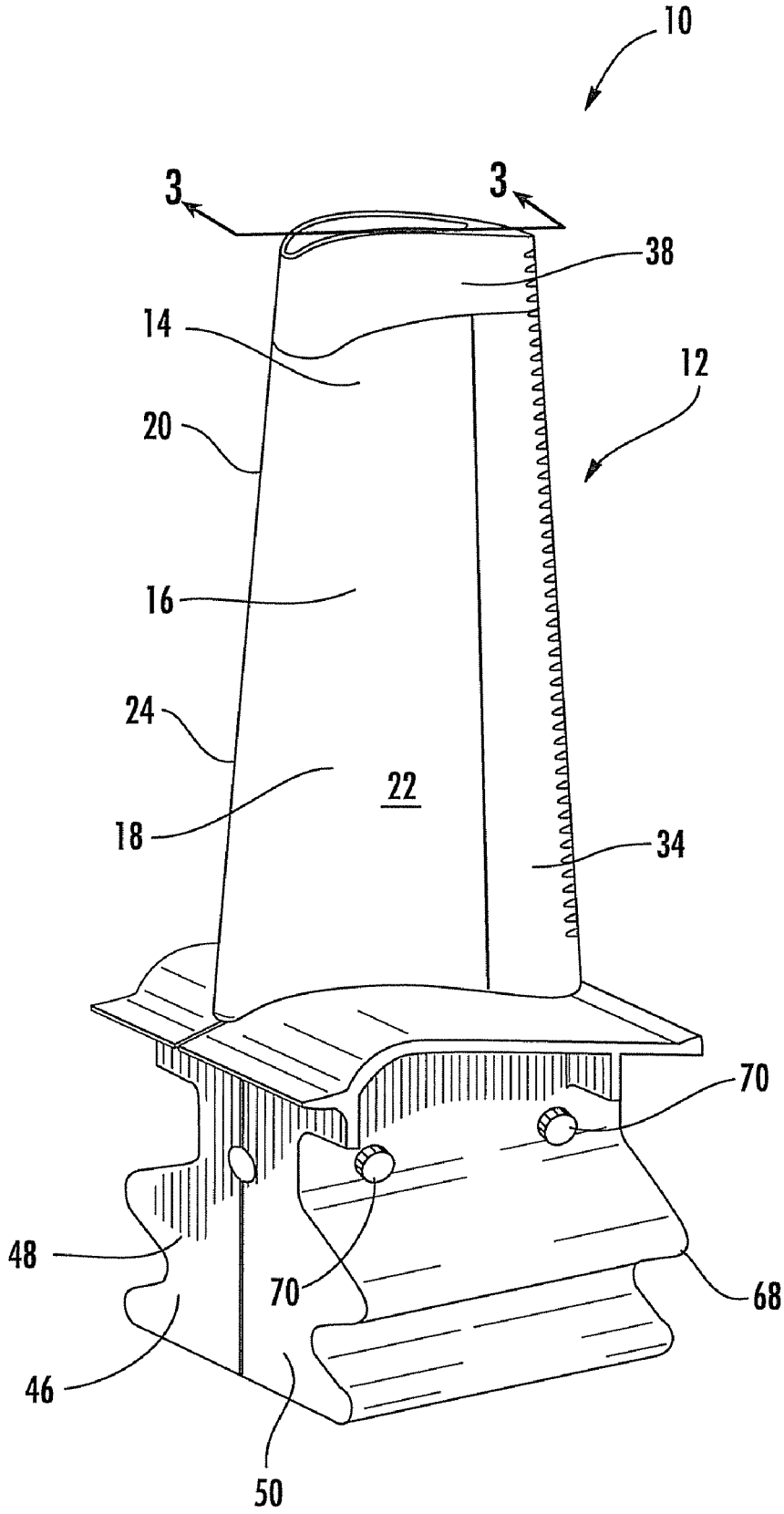
FIG. 1 is a perspective view of an airfoil having features according to the instant invention.
Figure 2:
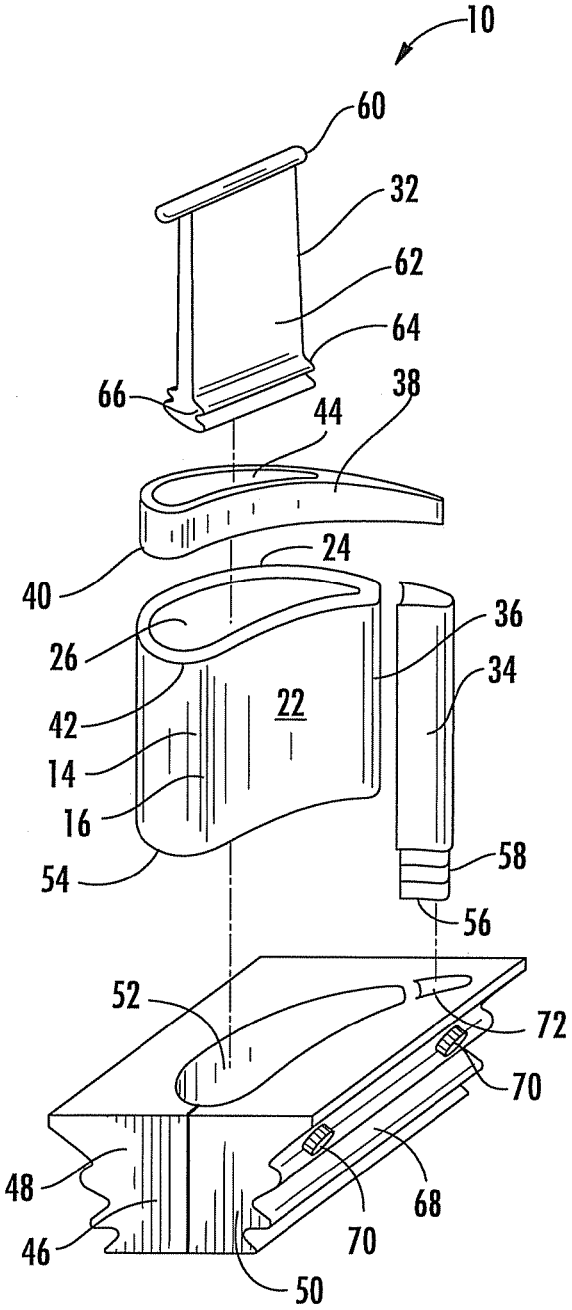
FIG. 2 is an exploded perspective view of the airfoil shown in FIG. 1.
Figure 5:
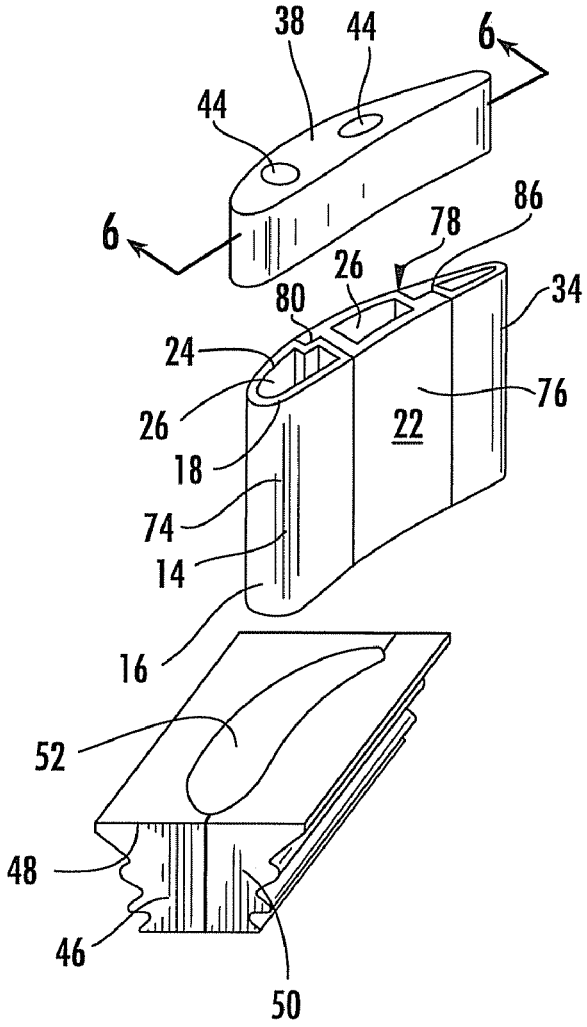
FIG. 5 is an exploded perspective view of an alternative airfoil.
Figure 7:
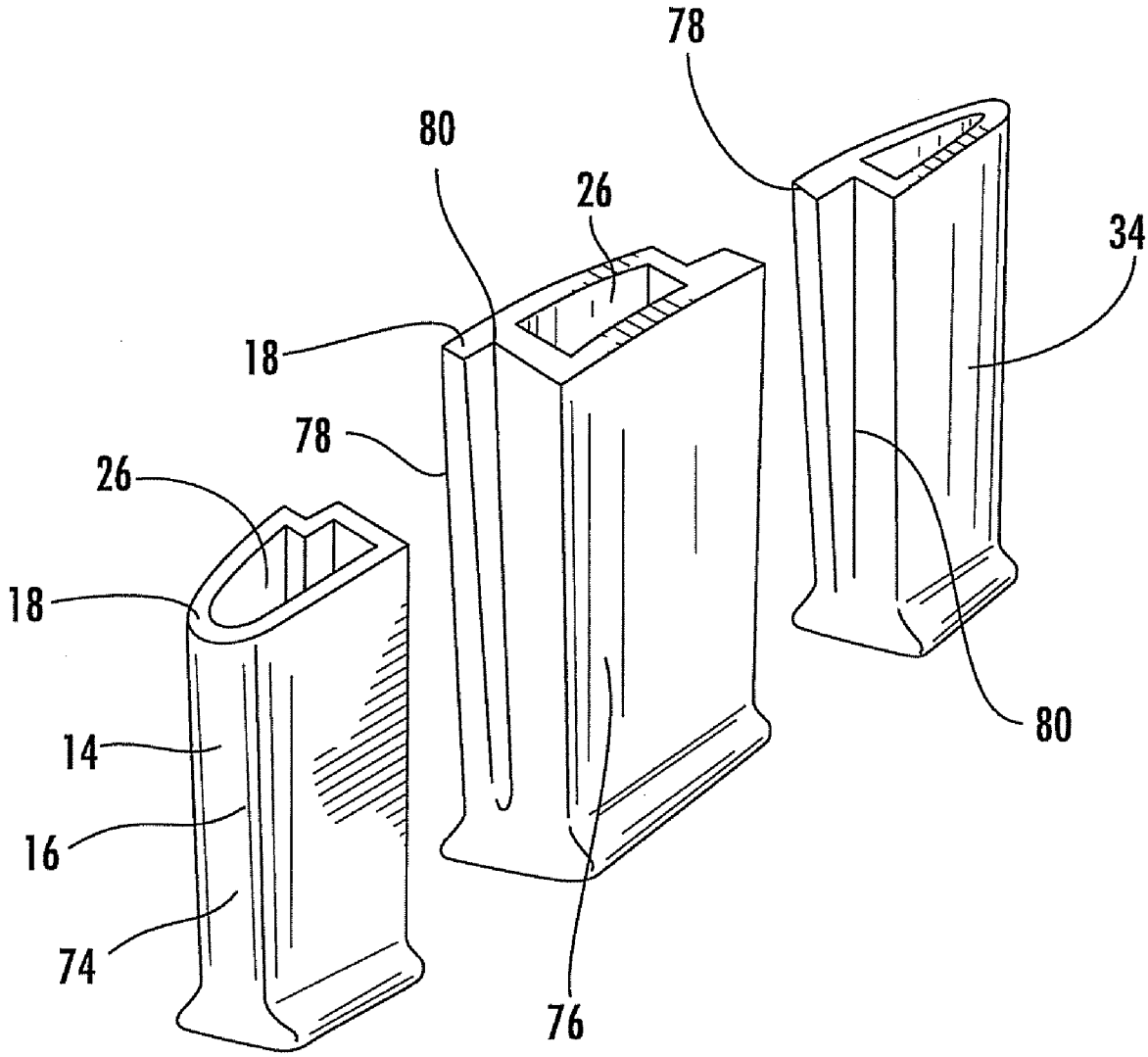
FIG. 7 is an exploded view of the airfoil of FIG. 5.

The multiple piece turbine airfoil 10 may be formed from one or more components 14 forming a generally elongated airfoil 16 with an outer wall 18 having a leading edge 20, a pressure side 22, and a suction side 24. The airfoil 16 may have any appropriate configuration and may be configured such that the pressure side 22 has a generally concave shape, and the suction side 24 has a generally convex shape. The leading and trailing edges 20, 24 may have any appropriate configurations. In one embodiment, as shown in FIGS. 1 and 2, the multiple piece turbine airfoil 10 may be formed from a component 14 forming the leading edge 20 and the middle portion of a generally elongated airfoil 16 and may include a separate trailing edge component 34 that may be sized to mate with a downstream end 36 of the component 14 forming a generally elongated airfoil 16 such that the flow of gases between the pressure side 22 and the suction side 24 are limited if not completed eliminated. As shown in FIG. 2, the airfoil component 14 may form an outer wall 18 with a single inner spar receiving chamber 26. In other embodiments, as shown in FIGS. 5 and 7, airfoil component 14 may include a plurality of spar receiving chambers 26. The trailing edge component 34 may be formed from the same material as the component 14 or from different materials capable of being exposed to the hot gases in the exhaust stream. The trailing edge component 34 may also include one or more cooling chambers, such as, but not limited to a pin fin cooling array.

The turbine airfoil 10 may also include an airfoil tip 38 with a perimeter 40 configuration that matches a perimeter 42 formed by the component 14 forming the generally elongated airfoil 16 and the trailing edge component 34. The airfoil tip 38 may include one or more one spar receiving recesses 44. The spar receiving recesses 44 may include an outer portion 28 having a larger cross-sectional area than an inner portion 30, which enables a spar 32 to be countersunk when installed thereby preventing and tip rub of the spar 32 from occurring during use.

Figure 4:
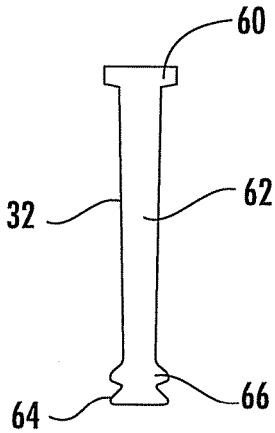
FIG. 4 is a side view of a spar of the airfoil of FIG. 1.

The turbine airfoil 10 may include a root 46 formed from separate first and second root sections 48, 50 that together form an airfoil receiving cavity 52 for containing an inner end 54 of the component 14 forming the generally elongated airfoil 16 and an inner end 56 of the trailing edge component 34. The inner end of the trailing edge component 34 may include a mechanical connection system 58 for attaching the trailing edge component 34 to the root sections 48, 50. The mechanical connection system 58 may be a fir-tree configuration, as shown in FIGS. 15-4, or other appropriate configuration. An inner surface forming the airfoil receiving cavity 52 may be configured to mate with a base 64 of a spar 32 to secure the components 14, 34 therein and to mate with an inner end of the trailing edge component 34. The first and second root sections 48, 50 may be coupled together to form the root 46 using one or more appropriate mechanical connection systems 70, such as, but not limited to, bolts and other releasable connectors. The root section 48, 50 may include a mechanical connection system 68 on an outer surface of the first and second root sections 48, 50. The mechanical connection system 68 may be a fir-tree configuration, as shown in FIGS. 1 and 2, or other appropriate configuration.

Figure 3:
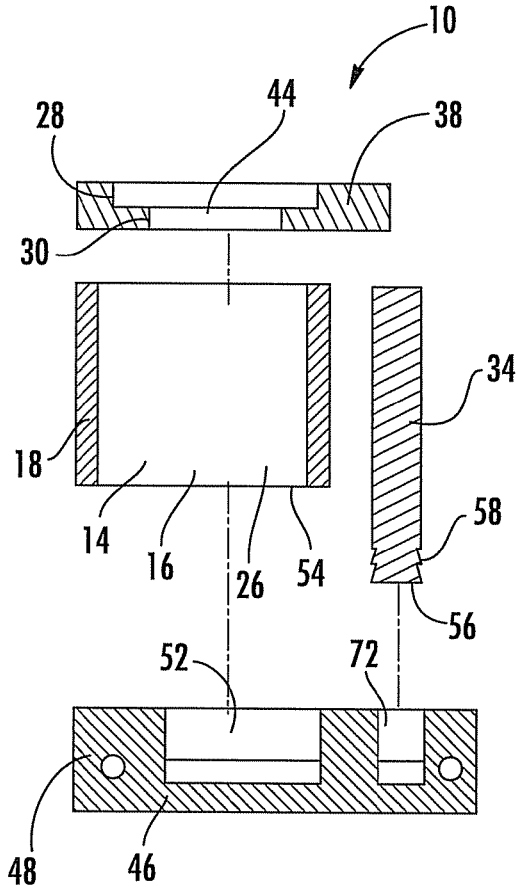
FIG. 3 is a cross-sectional view of the components of the airfoil of FIG. 1 taken at line 3-3.
Figure 6:
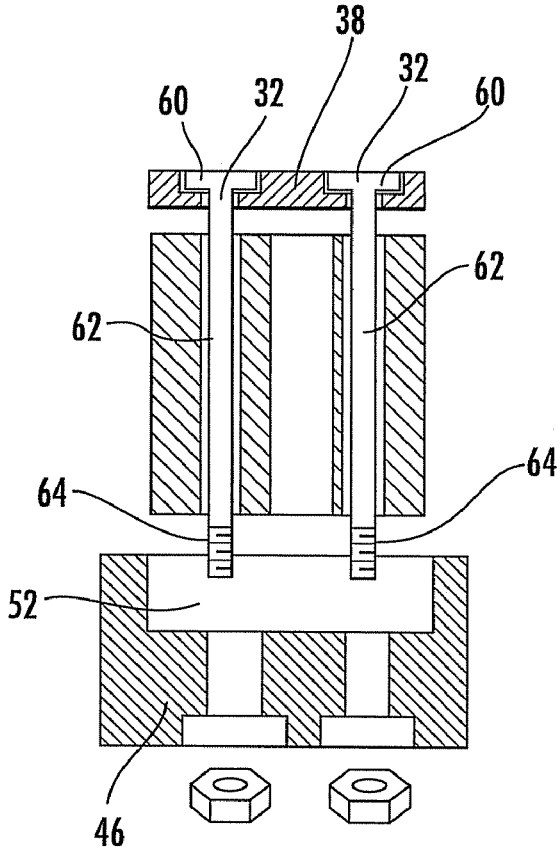
FIG. 6 is a cross-sectional view of the airfoil of FIG. 5 taken at line 6-6.

The turbine airfoil 10 may include one or more spars 32, as shown in FIGS. 2, 3 and 6, to place the outer wall 18 of the airfoil 16 into compression and to keep the components of the airfoil 10 together to form the airfoil 16. As shown in FIG. 2, the spar 32 may extend from the airfoil tip 38, through the component 14 forming a generally elongated airfoil 16, and into the airfoil receiving cavity 52 of the first and second root sections 48, 50 to secure the component 14 forming a generally elongated airfoil 16, the trailing edge component 34 and the airfoil tip 38 to the root 46. The spar 32 may include an outer head 60 having a cross-sectional area that fits within the outer portion 28 of the recess 44 of the airfoil tip 38, a body 62 with a cross-sectional area less than the outer head 60, and may include a mechanical connection system 66 at the base 64 of the spar 32. The mechanical connection system 66 may be a fir-tree configuration, as shown in FIG. 4, or may be a dovetail configuration, as shown in FIGS. 5 and 7. The mechanical connection system 66 may be configured to mate with an internal surface of the first and second root sections 48, 50. The mechanical connection system 66 of the spar 32 may be the same or different than the mechanical connection system 58 of the trailing edge component 34.

The components forming the turbine airfoil 10 may be formed from the same material or from two or more materials that are chosen to optimize construction by minimizing cost. For instance, components, such as the airfoil component 14 and the trailing edge component 34 may be formed from any appropriate materials capable of withstanding the high temperatures of the exhaust gases. In addition, other components, such as the spar 32 and the root sections 48, 50 may be formed from materials that have melting points lower then the material used to form the airfoil component 14 and the trailing edge component 34, which are also typically less expensive.

As shown in FIG. 2, the first and second root sections 48, 50 may include an airfoil receiving cavity 52 and a separate trailing edge receiving cavity 72. The trailing edge receiving cavity 72 may be configured to engage and mate with the mechanical connection system 58 on the inner end of the trailing edge component 34.

In another embodiment, as shown in FIGS. 5-7, the airfoil component 14 forming the generally elongated airfoil 16 may be formed from two sections, a leading edge section 74 and a middle section 76. Two spars 32, one in the leading edge section 74 and one in the middle section 76, may extend from the airfoil tip 38, through the two sections 74, 76 forming a generally elongated airfoil 16, and into the airfoil receiving cavity 52 of the first and second root sections 48, 50. The spars 32 may be, but are not limited to, bolts that palace the outer wall 18 forming the airfoil 16 into compression. The leading edge section 74 and a middle section 76 may include a seal 78 for reducing, if not completely eliminating, gas flow from the pressure side 22 to the suction side 24 of the airfoil 16. The seal 78 may be formed from an offset sidewall 80. The seal 78 may be brazed or otherwise sealed once the leading edge section 74 and a middle section 76 are mated together. Similarly, the intersection between the middle section 76 and the trailing edge component 34 may include a seal 78 for reducing, if not completely eliminating, gas flow from the pressure side 22 to the suction side 24 of the airfoil 16.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A multiple piece turbine airfoil, comprising:

at least one component forming a generally elongated airfoil with an outer wall having a leading edge, a pressure side, and a suction side, wherein the at least one component forming a generally elongated airfoil includes at least one spar receiving chamber;

a trailing edge component sized to mate with a downstream end of the at least one component forming a generally elongated airfoil;

an airfoil tip with a perimeter configuration that matches a perimeter formed by the at least one component forming a generally elongated airfoil and the trailing edge component and includes at least one spar receiving recess with an outer portion having a larger cross-sectional area than an inner portion;

a root formed from separate first and second root sections that together form an airfoil receiving cavity for containing an inner end of the at least one component forming a generally elongated airfoil and an inner end of the trailing edge component; and at least one spar extending from the airfoil tip, through the at least one component forming a generally elongated airfoil, and into the airfoil receiving cavity of the first and second root sections to secure the at least one component forming a generally elongated airfoil, the trailing edge component and the airfoil tip to the root.

2. The multiple piece turbine airfoil of claim 1, wherein the at least one spar includes an outer head having a cross-sectional area that fits within the outer portion of the at least one spar receiving recess of the airfoil tip, a body with a cross-sectional area less than the outer head, and includes a mechanical connection system at a base of the at least one spar.

3. The multiple piece turbine airfoil of claim 2, wherein the mechanical connection system at the base of the at least one spar is a fir-tree configuration that is configured to mate with an internal surface of the first and second root sections.

4. The multiple piece turbine airfoil of claim 1, wherein the first and second root sections include a mechanical connection system on an outer surface of the first and second root sections.

5. The multiple piece turbine airfoil of claim 4, wherein the mechanical connection system is a fir-tree configuration.

6. The multiple piece turbine airfoil of claim 1, wherein the at least one spar and the first and second root sections are formed from materials different than materials used to form the at least one component forming the generally elongated airfoil.

7. The multiple piece turbine airfoil of claim 1, wherein the first and second root sections are coupled together with at least one mechanical connector.

8. The multiple piece turbine airfoil of claim 1, wherein the at least one component forming a generally elongated airfoil is formed from an outer wall with a single inner spar receiving chamber.

9. The multiple piece turbine airfoil of claim 1, wherein the first and second root sections further include a trailing edge component receiving chamber.

10. The multiple piece turbine airfoil of claim 1, wherein the trailing edge component includes a pin fin cooling array.

11. The multiple piece turbine airfoil of claim 1, wherein the trailing edge component includes a mechanical connection system.

12. The multiple piece turbine airfoil of claim 11, wherein the mechanical connection system is a fir-tree configuration.

13. The multiple piece turbine airfoil of claim 1, wherein the at least one component forming a generally elongated airfoil is comprised of two sections, a leading edge section and a middle section, and two spars extend from the airfoil tip, through the two sections forming a generally elongated airfoil, and into the airfoil receiving cavity of the first and second root sections.

14. The multiple piece turbine airfoil of claim 13, wherein an intersection between the leading edge section and the middle section includes a seal formed from an offset sidewall.

15. A multiple piece turbine airfoil, comprising:

at least one component forming a generally elongated airfoil with an outer wall having a leading edge, a pressure side, and a suction side, wherein the at least one component forming a generally elongated airfoil includes at least one spar receiving chamber;

a trailing edge component sized to mate with a downstream end of the at least one component forming a generally elongated airfoil;

an airfoil tip with a perimeter configuration that matches a perimeter formed by the at least one component forming a generally elongated airfoil and the trailing edge component and includes at least one spar receiving recess with an outer portion having a larger cross-sectional area than an inner portion;

a root formed from separate first and second root sections that together form an airfoil receiving cavity for containing an inner end of the at least one component forming a generally elongated airfoil and an inner end of the trailing edge component; and at least one spar extending from the airfoil tip, through the at least one component forming a generally elongated airfoil, and into the airfoil receiving cavity of the first and second root sections to secure the at least one component forming a generally elongated airfoil, the trailing edge component and the airfoil tip to the root;

wherein the at least one spar includes an outer head having a cross-sectional area that fits within the outer portion of the at least one spar receiving recess of the airfoil tip, a body with a cross-sectional area less than the outer head, and includes a mechanical connection system at a base of the at least one spar;

wherein the first and second root sections are coupled together with at least one mechanical connector;

wherein the trailing edge component includes an attachment system that mates with internal wall of a trailing edge cavity in the first and second root sections;

wherein the first and second root sections further include a trailing edge component receiving chamber;

wherein the first and second root sections include a mechanical connection system on an outer surface of the first and second root sections.

16. The multiple piece turbine airfoil of claim 15, wherein the mechanical connection system at the base of the at least one spar is a fir-tree configuration that is configured to mate with an internal surface of the first and second root sections.

17. The multiple piece turbine airfoil of claim 15, wherein the at least one component forming a generally elongated airfoil is formed from an outer wall with a single inner spar receiving chamber.

18. The multiple piece turbine airfoil of claim 15, wherein the trailing edge component includes a pin fin cooling array.

19. A multiple piece turbine airfoil, comprising:

a leading edge component and a middle component that together form a generally elongated airfoil with an outer wall having a leading edge, a pressure side, and a suction side, wherein each of the leading edge component and the middle component form a generally elongated airfoil and each includes at least one spar receiving chamber;

a trailing edge component sized to mate with a downstream end of the middle component;

an airfoil tip with a perimeter configuration that matches a perimeter formed by the leading edge component, the middle component and the trailing edge component and includes at least one spar receiving recess with an outer portion having a larger cross-sectional area than an inner portion;

a root formed from separate first and second root sections that together form an airfoil receiving cavity for containing an inner end of the at least one component forming a generally elongated airfoil and an inner end of the trailing edge component;

at least one spar extending from the airfoil tip, through the leading edge component forming a generally elongated airfoil, and into the airfoil receiving cavity of the first and second root sections to secure the leading edge component to the root;

at least one spar extending from the airfoil tip, through the middle component forming a generally elongated airfoil, and into the airfoil receiving cavity of the first and second root sections to secure the middle component to the root;

wherein an intersection between the leading edge section and the middle section includes a seal formed from an offset sidewall and an intersection between the middle section and the trailing edge component includes a seal formed from an offset sidewall;

wherein the spars include outer heads having cross-sectional areas that fit within the outer portion of the spar receiving recesses, a body with a cross-sectional area less than the outer head, and a mechanical connection system at a base of the at least one spar;

wherein the first and second root sections are coupled together with at least one mechanical connector;

wherein the first and second root sections further include a trailing edge component receiving chamber;

wherein the first and second root sections include a mechanical connection system on an outer surface of the first and second root sections.

20. The multiple piece turbine airfoil of claim 1, wherein the leading edge, middle and trailing edge sections include a dovetail base.

* * * * *